US006692631B2

(12) United States Patent
Bergsma

(10) Patent No.: US 6,692,631 B2
(45) Date of Patent: Feb. 17, 2004

(54) CARBON CONTAINING CU-NI-FE ANODES FOR ELECTROLYSIS OF ALUMINA

(75) Inventor: S. Craig Bergsma, The Dalles, OR (US)

(73) Assignee: Northwest Aluminum, The Dalles, OR (US)

( * ) Notice: Subject to any disclaimer, the term of this patent is extended or adjusted under 35 U.S.C. 154(b) by 155 days.

(21) Appl. No.: 10/076,240

(22) Filed: Feb. 15, 2002

(65) Prior Publication Data

US 2003/0155253 A1 Aug. 21, 2003

(51) Int. Cl.[7] ..... C25C 3/12
(52) U.S. Cl. ..... 205/385
(58) Field of Search ..... 204/293, 294, 204/243.1; 205/385; 420/458, 487, 92

(56) References Cited

U.S. PATENT DOCUMENTS

| | | | | | |
|---|---|---|---|---|---|
| 3,943,048 | A | | 3/1976 | Fisher et al. | 204/290 |
| 3,957,600 | A | | 5/1976 | Ives et al. | 204/105 R |
| 4,049,887 | A | | 9/1977 | Whittingham | 429/112 |
| 4,251,715 | A | * | 2/1981 | Petersson et al. | 219/284 |
| 4,620,905 | A | | 11/1986 | Tarcy et al. | 204/64 R |
| 4,818,307 | A | * | 4/1989 | Mori et al. | 147/414 |
| 4,865,701 | A | | 9/1989 | Beck et al. | 204/67 |
| 4,871,438 | A | | 10/1989 | Marschman et al. | 204/291 |
| 4,956,068 | A | | 9/1990 | Nguyen et al. | 204/242 |
| 4,960,494 | A | | 10/1990 | Nguyen et al. | 204/67 |
| 4,999,097 | A | | 3/1991 | Sadoway | 204/243 |
| 5,006,209 | A | | 4/1991 | Beck et al. | 204/67 |
| 5,069,771 | A | | 12/1991 | Nguyen et al. | 204/292 |
| 5,284,562 | A | * | 2/1994 | Beck et al. | 204/243 R |
| 5,529,494 | A | | 6/1996 | Vlacancich | 433/105 |
| 5,637,239 | A | | 6/1997 | Adamski et al. | 219/69.15 |
| 5,667,649 | A | | 9/1997 | Bushman | 204/290 R |
| 5,725,744 | A | | 3/1998 | deNora et al. | 204/244 |
| 5,993,637 | A | | 11/1999 | Hisamatsu et al. | 205/652 |

* cited by examiner

*Primary Examiner*—Roy King
*Assistant Examiner*—Harry D. Wilkins, III
(74) *Attorney, Agent, or Firm*—Andrew Alexander

(57) ABSTRACT

A method of producing aluminum in a low temperature electrolytic cell containing alumina dissolved in an electrolyte. The method comprises the steps of providing a molten electrolyte having alumina dissolved therein in an electrolytic cell containing the electrolyte. A non-consumable anode and cathode is disposed in the electrolyte, the anode comprised of Cu—Ni—Fe alloys containing 0.1 to 5 wt. % carbon and incidental elements and impurities. Electric current is passed from the anode, through the electrolyte to the cathode thereby depositing aluminum on the cathode, and molten aluminum is collected from the cathode.

18 Claims, 3 Drawing Sheets

CARBON CONTAINING CU-NI-FE ANODES FOR ELECTROLYSIS OF ALUMINA

BACKGROUND OF THE INVENTION

This invention relates to electrolytic production of aluminum and more particularly, it relates to an improved anode and/or lining composition for use in a cell for the electrolytic production of aluminum.

In the electrolytic reduction of aluminum, there is great interest in utilizing an anode which is substantially inert to the electrolyte and which does not react with oxygen during cell operation. Anodes of this type are described in U.S. Pat. No. 4,399,008 which discloses a composition suitable for fabricating into an inert electrode for use in the electrolytic production of metal from a metal compound dissolved in a molten salt. The electrode comprises at least two metal oxides combined to provide a combination metal oxide.

Also, U.S. Pat. No. 5,284,562 discloses an oxidation resistant, non-consumable anode for use in the electrolytic reduction of alumina to aluminum, which has a composition comprising copper, nickel and iron. The anode is part of an electrolytic reduction cell comprising a vessel having an interior lined with metal which has the same composition as the anode. The electrolyte is preferably composed of a eutectic of $AlF_3$ and either (a) NaF or (b) primarily NaF with some of the NaF replaced by an equivalent molar amount of KF or KF and LiF.

U.S. Pat. No. 5,069,771 discloses a method of electrowinning a metal by electrolysis of a melt containing a dissolved species of the metal to be won using a non-consumable anode having a metal, alloy or cermet substrate and an operative anode surface which is a protective surface coating of cerium oxyfluoride preserved by maintaining in the melt a suitable concentration of cerium. The anode is provided with an electronically conductive oxygen barrier on the surface of the metal, alloy or cermet substrate. The barrier layer may be a chromium oxide film on a chromium-containing alloy substrate. Preferably the barrier layer carries a ceramic oxide layer, e.g. of stabilized copper oxide which acts as anchorage for the cerium oxyfluoride.

U.S. Pat. No. 3,957,600 discloses anodes of alloys, which may be fragmented and used in baskets, of passive film-forming metals and elements having atomic numbers 23–29 for use in electrowinning metals, methods of using such anodes, and electrowinning cells incorporating such anodes.

Further, U.S. Pat. No. 4,529,494 discloses a monolithic bipolar electrode for the production of primary aluminum by molten salt electrolysis composed of a cermet anodic layer, a conductive and diffusion-resistant intermediate layer, and a refractory hard metal cathodic layer, with the edges covered by an electrolyte-resistant coating. The intermediate conductive layer has a coefficient of thermal expansion intermediate to the anodic and cathodic layers.

U.S. Pat. No. 4,620,905 discloses an electrolytic process comprising evolving oxygen on an anode in a molten salt, the anode comprising an alloy comprising a first metal and a second metal, both metals forming oxides, the oxide of the first metal being more resistant than the second metal to attack by the molten salt, the oxide of the second metal being more resistant than the first metal to the diffusion of oxygen. The electrode may also be formed of $CuAlO_2$ and/or $Cu_2O$.

U.S. Pat. No. 4,871,438 discloses cermet electrode compositions comprising NiO—$NiFe_2O_4$—Cu—Ni, and methods for making the same. Addition of nickel metal prior to formation and densification of a base mixture into the cermet allows for an increase in the total amount of copper and nickel that can be contained in the NiO—$NiFe_2O_4$ oxide system. Nickel is present in a base mixture weight concentration of from 0.1% to 10%. Copper is present in the alloy phase in a weight concentration of from 10% to 30% of the densified composition.

U.S. Pat. No. 4,999,097 discloses improved electrolytic cells and methods for producing metals by electrolytic reduction of a compound dissolved in a molten electrolyte. In the improved cells and methods, a protective surface layer is formed upon at least one electrode in the electrolytic reduction cell and, optionally, upon the lining of the cell.

U.S. Pat. No. 5,006,209 discloses that finely divided particles of alumina are electrolytically reduced to aluminum in an electrolytic reduction vessel having a plurality of vertically disposed, non-consumable anodes and a plurality of vertically disposed, dimensionally stable cathodes in closely spaced, alternating arrangement with the anodes.

U.S. Pat. No. 4,865,701 discloses that alumina is reduced to molten aluminum in an electrolytic cell containing a molten electrolyte bath composed of halide salts and having a density less than alumina and aluminum and a melting point less than aluminum. The cell comprises a plurality of vertically disposed, spaced-apart, non-consumable, dimensionally stable anodes and cathodes. Alumina particles are dispersed in the bath to form a slurry. Current is passed between the electrodes, and oxygen bubbles form at the anodes, and molten aluminum droplets form at the cathodes. The oxygen bubbles agitate the bath and enhance dissolution of the alumina adjacent the anodes and inhibit the alumina particles from settling at the bottom of the bath. The molten aluminum droplets flow downwardly along the cathodes and accumulate at the bottom of the bath.

Additional anode compositions are described in U.S. Pat. Nos. 3,943,048; 4,049,887; 4,956,068; 4,960,494; 5,637,239; 5,667,649; 5,725,744 and 5,993,637.

There is still a need to improve the corrosivity and conductivity of the non-consumable anode to ensure an anode that provides satisfactory performance without dissolution in an electrolytic cell where alumina is reduced to aluminum.

SUMMARY OF THE INVENTION

It is an object of this invention to provide an improved anode for use in an electrolytic cell.

It is another object of this invention to provide an improved composition for an anode having resistance to molten electrolyte salts in an aluminum producing electrolytic cell.

Yet, it is another object of the invention to provide a process for electrolytically producing aluminum from alumina in a low temperature cell using an improved anode.

These and other objects will become apparent from a reading of the specification, claims and drawings appended hereto.

In accordance with these objects, there is provided a method of producing aluminum in an electrolytic cell comprising the steps of providing molten electrolyte in an electrolytic cell, said cell having alumina dissolved in the electrolyte. In addition, anodes and cathodes are provided in the cell, the anodes comprised of Cu—Ni—Fe alloys containing about 0.1 to 5 wt. % carbon, incidental elements and impurities. Electric current is passed between an anode and a cathode in the cell and aluminum is formed at the cathode.

The anode has improved resistance to oxidation and corrosion in molten electrolyte baths compared to other anode compositions in the same bath. The anode is comprised of Cu—Ni—Fe alloys containing 0.1 to 5 wt. % carbon. Preferably, the anode composition is comprised of 15 to 60 wt. % Ni, 1 to 50 wt. % Fe, 0.1 to 5 wt. % C, the remainder Cu, incidental elements and impurities. A more preferred anode is selected from a composition in the range of 10 to 70 wt. % Cu, 15 to 60 wt. % Ni, 15 to 40 wt. % Fe and 0.1 to 5 wt. % C. A typical composition for the anode would contain 30 to 50 wt. % Cu, 20 to 40 wt. % Ni, 20 to 40 wt. % Fe and 0.7 to 2 wt. % C, with a specific composition containing about 41 wt. % Cu, 28 wt. % Ni, 30 wt. % Fe and 1 wt. % C.

Another feature of the present invention is a cell vessel interior lining which is impervious to penetration by molten electrolyte, which can be readily replaced and which may be readily recycled. The lining covers the bottom and walls of the vessel interior and may be composed of an alloy having substantially the same composition as the anode composition described herein. Located between the external shell and the interior metal lining of the vessel is refractory material, such as alumina or insulating fire brick, which thermally insulates the bottom and walls of the vessel. The interior metal lining may be electrically connected to the anodes, and the walls or bottom or both then constitute part of the anode arrangement. During operation of the cell, oxygen bubbles are generated at the bottom and elsewhere on the interior metal lining when the latter is part of the anode arrangement, and these bubbles help to maintain in suspension in the molten electrolyte the finely divided alumina particles introduced into the cell.

The anodes of the present invention may be fabricated by casting a Cu—Ni—Fe—C melt of the desired composition. Or, the anodes may be fabricated from sintered metal powders of the desired proportions to produce an anode having a porous surface and a density substantially less than the theoretical density for a given composition (e.g., 60–70% of theoretical density). These anodes have resistance to corrosion by oxidation, when immersed in the cell's electrolyte. However, the denser anodes have a greater resistance to oxidation in air. The cast anodes have the advantage that they produce a very hard protective coating during use in the cell.

Preferably, a cell in accordance with the present invention employs, as an electrolyte, a eutectic or near-eutectic composition consisting essentially of 42–46 mol. % $AlF_3$ (preferably 43–45 mol. % $AlF_3$) and 54–58 mol. % of either (a) all NaF or (b) primarily NaF with equivalent molar amounts of KF or KF plus LiF replacing some of the NaF.

DETAILED DESCRIPTION OF THE PREFERRED EMBODIMENTS

Anodes of the present invention may be employed in any aluminum producing electrolytic cell. Further, the anodes may be used with any electrolyte which does not oxidize or cause degradation of the electrode during electrolysis. Preferred electrolytes are set forth in our U.S. Pat. No. 5,284,562 incorporated herein by reference as if specifically set forth.

Figure 1:
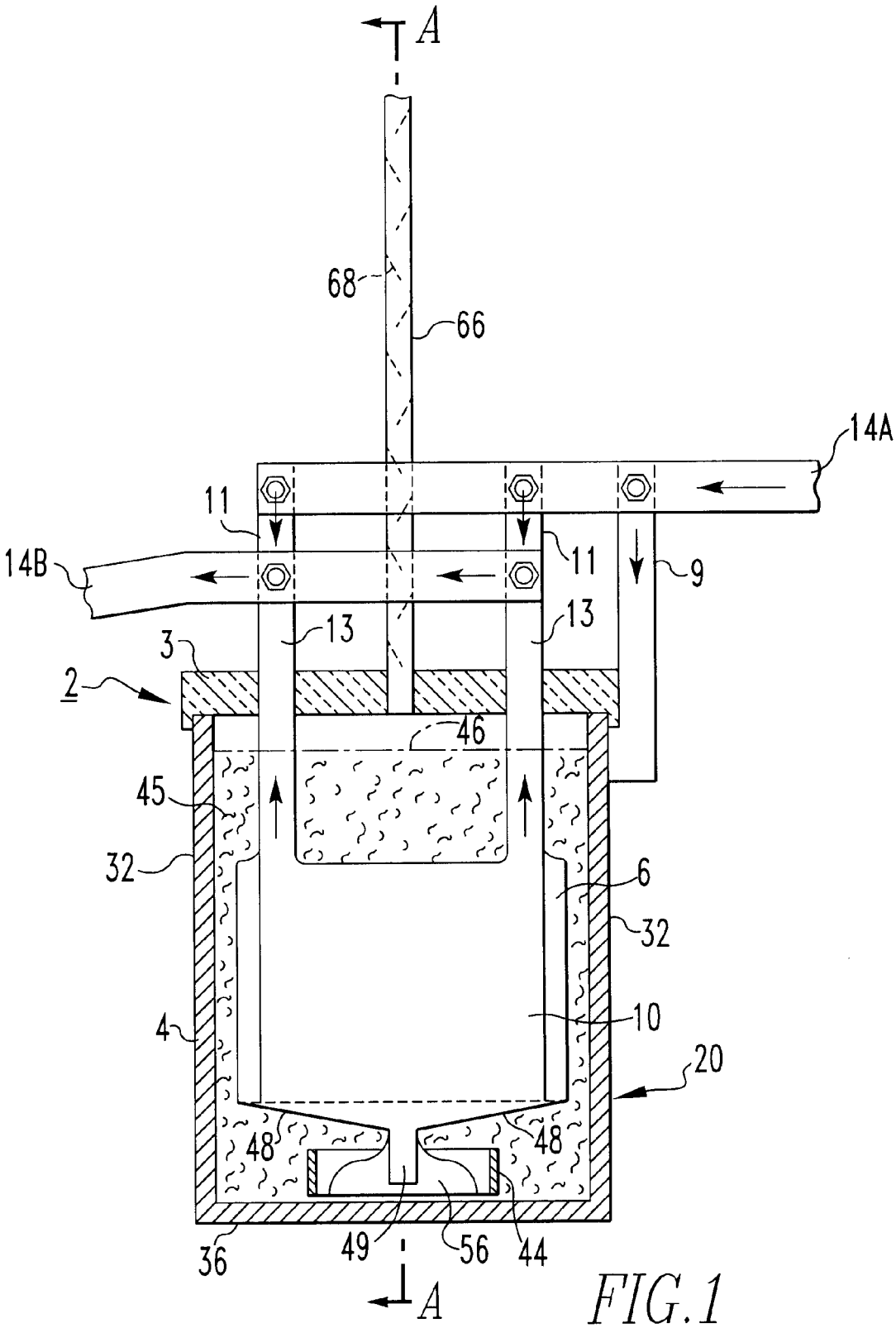
FIG. 1 is a cross-sectional view of a 300 amp cell showing two cathodes and an anode.
Figure 2:
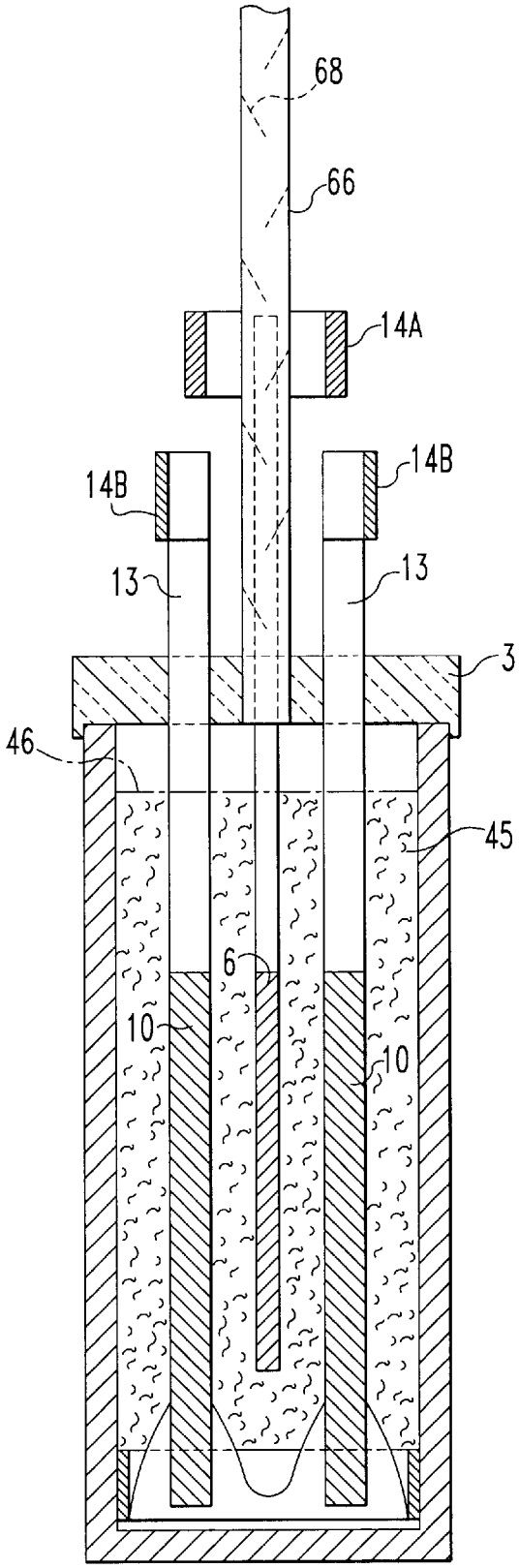
FIG. 2 is a cross-sectional view along the line A—A of FIG. 1.

A cell used for testing inert anodes in accordance with the invention is shown in FIGS. 1 and 2. FIG. 2 is a cross-sectional view along the line A—A of FIG. 1. Cell 2 of FIG. 1 consists of a metal container 20 comprised of metal liner 4 that may be held at anode potential. Within container 20, two vertical plate cathodes 10 (see FIG. 2) and a vertical plate anode 6 are suspended from bus bars 14A and 14B. Bus bar 14A is connected to anode 6 utilizing straps 11 and to container 20 using strap 9. Bus bar 14B is connected to cathode 10 using straps 13. Molten electrolyte 45 is provided in the cell and the anode and cathodes are immersed under surface 46 of the electrolyte. Cell 2 is provided with lid 3 and alumina is added through lid 3 to the cell using tube 66.

In operation, electrical current from bus bar or anode collector bar 14A flows through electrical strap 9 into anodic liner 4. Current also flows from 14A through conducting straps 11 to anode 6 and then through electrolyte 45 to cathodes 10. The current then flows from cathodes 10 along connection straps 13 to a second bus bar 14B or cathode collector bar 14B. Molten aluminum 56 deposited on the cathode flows to protrusion 49 and is collected in a pool in container 44 at bottom 36 of cell 2.

Inert anodes in accordance with the invention may be cast from a melt of an alloy having the desired composition or the anodes may be fabricated from powders of the individual components mixed in the desired proportions. The powders are then sintered or melted to form the anode. For purposes of preparing Cu—Ni—Fe—C anodes, sufficient carbon can be obtained by melting powders of Cu—Ni—Fe in the required proportions in a graphite crucible. That is, a powder charge containing about 42 wt. % Cu, 30 wt. % Ni and 28 wt. % Fe, after melting in a graphite crucible by heating to about 2650° F., will absorb or dissolve about 0.7 to 1 wt. % C from the crucible. The melting should be performed under an argon atmosphere using an induction furnace. If a refractory crucible is used, carbon may be added in the form of powder or graphite pieces or rods. The melt can be cast to the desired anode size or it can be cast into a slab and machined to size.

Anodes in accordance with the invention are comprised of Cu—Ni—Fe alloys containing about 0.1 to 5 wt. % carbon. Fe in the anodes may range from 1 to 45 wt. % and Cu can range from 10 to 70 wt. %. Ni can range from 15 to 60 wt. %. Suitable anode compositions are in the ranges of 10 to 70 wt. % Cu, 15 to 60 wt. % Ni, 0.1 to 5 wt. % C, the remainder Fe, incidental elements and impurities. The Fe can be in the range of 1 to 40 wt. %. Preferably, anode compositions are in the ranges of 35 to 70 wt. % Cu, 25 to 48 wt. % Ni, 0.1 to 5 wt. % C, the remainder Fe with suitable amounts of Fe being in the range of 2 to 17 wt. %. More preferably, anode compositions can be selected from the range of 45 to 70 wt. % Cu, 28 to 42 wt. % Ni, 0.1 to 5 wt. % C and 13 to 17 wt. % Fe. Preferred ranges for carbon in the anode composition is about 0.3 to 3.5 wt. % with a typical amount of carbon being in the range of about 0.5 to 2 wt. %. It will be appreciated that carbon may extend beyond these ranges, depending to some extent on the amounts of Cu, Ni and Fe. The ranges set forth herein are intended to include all the numbers within the range as if specifically set forth.

The cathode may be comprised of a material selected from titanium diboride, zirconium diboride, titanium carbide, zirconium carbide, or a metal such as molybdenum or titanium.

The electrolytic cell can have an operating temperature less than 900° C. and typically in the range of 660° C. (1220° F.) to about 800° C. (1472° F.). Typically, the cell can employ electrolytes comprised of $NaF+AlF_3$ eutectics, $KF+AlF_3$ eutectic, and LiF. The electrolyte can contain 6 to 26 wt. % NaF, 7 to 33 wt. % KF, 1 to 6 wt. % LiF and 60 to 65 wt. % $AlF_3$. More broadly, the cell can use electrolytes that contain one or more alkali metal fluorides and at least one metal fluoride, e.g., aluminum fluoride, and use a combination of fluorides as long as such baths or electrolytes operate at less than about 900° C. For example, the electrolyte can comprise NaF and $AlF_3$. That is, the bath can comprise 53 to 62 mol. % NaF and 38 to 47 mol. % $AlF_3$.

It will be appreciated that the anode composition can be used with other electrolyte bath compositions and such is intended within the purview of the invention. For example, the electrolyte can contain one or more alkali metal fluorides and at least one other metal fluoride, e.g., aluminum, calcium or magnesium fluoride, as long as such baths can be operated at less than about 900° C.

Figure 3:
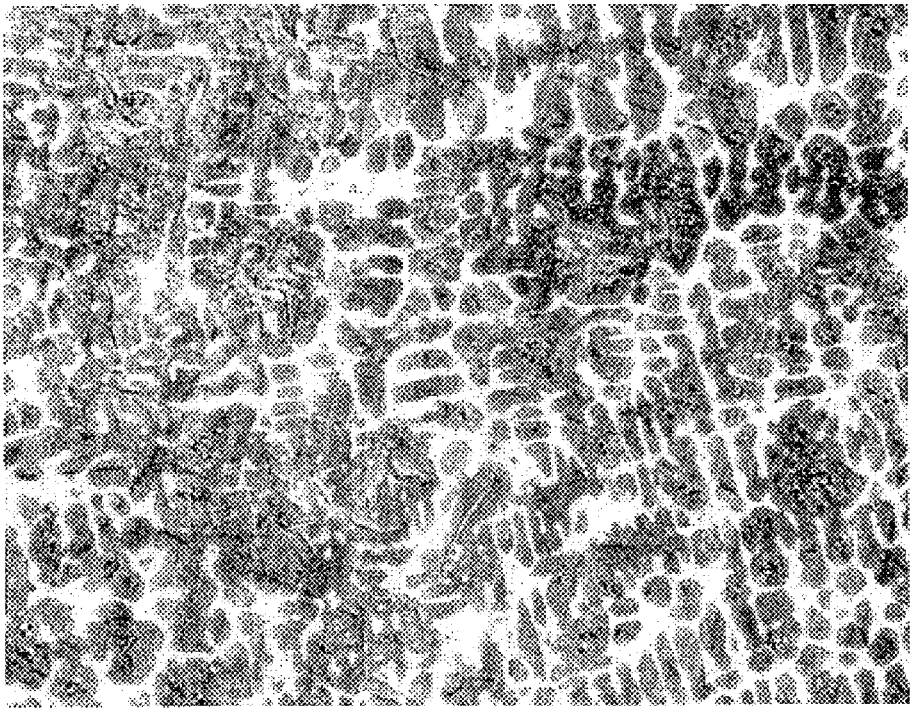
FIG. 3 is a micrograph of the as-cast metallurgical structure of an anode of the invention having the composition 41% Cu, 30% Ni, 28% Fe, and 1% C after chromic acid etch (200×).
Figure 4:
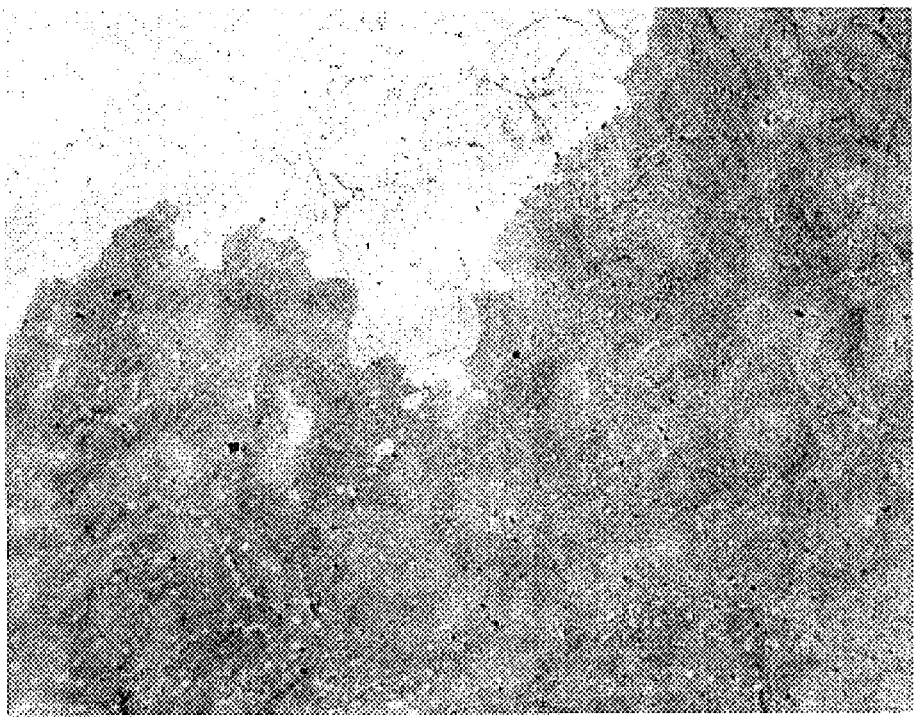
FIG. 4 is a micrograph of the metallurgical structure of a cast anode of the invention after homogenization having the same composition as in FIG. 3 etched in chromic acid (100×).

When an anode is fabricated from a melt of Cu—Ni—Fe—C by casting, normally two metallurgical phases or structures are produced, as shown in FIG. 3 which is a micrograph at 200× of the structure after a chromic acid etch. It has been found that by homogenizing the cast anode a phase change can be obtained. The two phases are changed into a single phase of as shown in FIG. 4 which is a micrograph at 100× of the homogenized structure after chromic acid etch. That is, the two phases are changed into a single phase. The homogenization can be carried out at sufficiently high temperature and for a sufficiently long time to obtain a single phase metallurgical structure. Thus, for example, the cast anode can be homogenized in a temperature range of 950° to 1250° C. for about 1 to 12 hours. A typical temperature range for homogenizing is about 1000° to 1100° C. with lower temperatures requiring longer times and higher temperatures requiring shorter times to effect a phase change. A specific temperature which will effect a phase change in a cast anode is about 1100° C. The time typically is about 8 hours; however, longer or shorter times may be required, depending on the compositions.

The single phase has the benefit that it offers a more uniform microstructure for an anode surface with less competing structures for oxidation. Further, it offers reduced rate of attack by insipient diffusion on the copper rich as-cast matrix.

The anodes and cathodes are spaced to provide an anode-cathode distance in a range of ¼ to 1 inch.

The following examples are further illustrative of the invention.

EXAMPLE 1

To test the invention, an anode having about 42 wt. % Cu, 28 wt. % Ni, 30 wt. % Fe and having 1.5 wt. % C dissolved therein was cast to shape and used in a 300 amp electrolytic cell, as shown in FIGS. 1 and 2, operated at about 755° C. The cell comprises a metal container having a bottom and walls fabricated from an as-cast alloy containing about 42 wt. % Cu, 28 wt. % Ni and 30 wt. % Fe, and approximately 1 wt. % carbon dissolved therein. The cell was maintained at anode potential. The molten electrolyte used in the cell contained about 61 wt. % $AlF_3$ and 39 wt. % NaF. The anode had a size of about 6 inches by 4 ¼ inches and about ¼ inch thick. Alumina having a particle size of about 100 $\mu$m was maintained at saturation or slightly above saturation. The cell utilized two titanium cathodes placed on either side of the anode to provide an anode-cathode distance of 0.5 inch. Aluminum produced on the cathodes was collected in an electrically insulated reservoir on the bottom of the cell and was removed from the cell periodically. The cell was run for a total of 100 hours at a current density ranging from about 0.23 to 0.5 amps/cm$^2$. After the 100 hours, the anode was removed and weighed. No weight loss of the anode was detected. Further, inspection of the anode surface revealed that a very hard protective coating had formed which required grinding to remove a small portion. The carbon containing anode had the benefit of a harder protective coating compared to similar Cu-Ni-Fe anodes without carbon.

EXAMPLE 2

This test was run substantially the same as in Example 1 except that an anode consisting essentially of 42 wt. % Cu, 30 wt. % Ni and 28 wt. % Fe and no carbon was used. After the run, the anode was inspected and found to have a soft coating which was easily removed.

Thus, it will be seen from the examples that the carbon containing anode developed a hard coating difficult to remove and the anode without carbon developed a soft coating which was easily removed. The carbon containing anode did not experience any substantial weight loss in this test and operated at a lower voltage.

While the invention has been described in terms of preferred embodiments, the claims appended hereto are intended to encompass other embodiments which fall within the spirit of the invention.

What is claimed is:

1. A method of producing aluminum in a low temperature electrolytic cell containing alumina dissolved in an electrolyte, the method comprising the steps of:

(a) providing a molten electrolyte having alumina dissolved therein in an electrolytic cell containing said electrolyte;

(b) providing a non-consumable anode and cathode disposed in said electrolyte, said anode comprised of a Cu—Ni—Fe alloy containing 0.1 to 5 wt. % carbon, incidental elements and impurities;

(c) passing electric current from said anode, through said electrolyte to said cathode thereby depositing aluminum on said cathode; and (d) collecting molten aluminum from said cathode.

2. The method in accordance with claim 1 including operating said cell to maintain said electrolyte in a temperature range of about 660° to 800° C.

3. The method in accordance with claim 1 including using an electrolyte comprised of one or more alkali metal fluorides.

4. The method in accordance with claim 1 including maintaining up to 30 wt. % undissolved alumina particles in said electrolyte to provide a slurry therein.

5. The method in accordance with claim 4 wherein undissolved alumina has a particle size in the range of 1 to 100 $\mu$m.

6. The method in accordance with claim 1 wherein Fe in said anode ranges from 1 to 50 wt. %.

7. The method in accordance with claim 1 including passing an electric current through said cell at a current density in the range of 0.1 to 1.5 A/cm$^2$.

8. The method in accordance with claim 1 including using a cathode comprised of a material selected from the group consisting of titanium diboride, zirconium boride, titanium carbide, zirconium carbide and titanium.

9. The method in accordance with claim 1 including providing said anode and said cathode substantially vertical or upright in said electrolyte and arranging said anodes and said cathode in alternating relationship.

10. The method in accordance with claim 1 wherein said anode is comprised of 10 to 70 wt. % Cu, 15 to 60 wt. % Ni, and 0.1 to 5 wt. % C, the remainder iron, incidental elements and impurities.

11. The method in accordance with claim 1 wherein said anodes are cast anodes comprising Cu—Ni—Fe and containing 0.1 to 5 wt. % carbon.

12. The method in accordance with claim 1 wherein said cell is comprised of metal bottom and sidewalls for containing said electrolyte, at least one of said bottom and sidewalls comprised of a composition which is the same as said anode.

13. The method in accordance with claim 1 wherein at least one of said metal bottom and sidewalls are electrically connected to said anodes thereby making at least one of said bottom and sidewalls anodic.

14. The method in accordance with claim 1 wherein said electrolyte is comprised of one or more alkali metal fluorides and at least one metal fluoride.

15. The method in accordance with claim 1 wherein said electrolyte is comprised of NaF and $AlF_3$.

16. A method of producing aluminum in a low temperature electrolytic cell containing alumina dissolved in an electrolyte, the method comprising the steps of:

(a) providing a cell comprising a vessel having a bottom and walls extending upwardly from said bottom for containing electrolyte;

(b) providing a molten electrolyte having alumina dissolved therein in said vessel;

(c) providing a plurality of generally vertically disposed non-consumable anodes and a plurality of generally vertically disposed cathodes in said electrolyte in alternating relationship with said anodes, said anodes are cast anodes comprised of about 10 to 70 wt. % Cu, 15 to 60 wt. % Ni, 15 to 40 wt % Fe and 0.1 to 5 wt. % C;

(d) passing an electric current through said vessel to said anodes and through said electrolyte to said cathodes, thereby depositing aluminum on said cathodes; and (e) collecting aluminum from said cathodes.

17. The method in accordance with claim 16 wherein said electrolyte is comprised of one or more alkali metal fluorides and at least one metal fluoride.

18. The method in accordance with claim 16 wherein said electrolyte is comprised of NaF and $AlF_3$.

* * * * *